US011506427B2

(12) United States Patent
Lee et al.

(10) Patent No.: US 11,506,427 B2
(45) Date of Patent: Nov. 22, 2022

(54) AIR CONDITIONING APPARATUS

(71) Applicant: LG ELECTRONICS INC., Seoul (KR)

(72) Inventors: Jisung Lee, Seoul (KR); Ahrae Jo, Seoul (KR); Yongcheol Sa, Seoul (KR); Chiwoo Song, Seoul (KR); Ilyoong Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 267 days.

(21) Appl. No.: 17/088,760

(22) Filed: Nov. 4, 2020

(65) Prior Publication Data

US 2021/0222918 A1 Jul. 22, 2021

(30) Foreign Application Priority Data

Jan. 21, 2020 (KR) ..... 10-2020-0007676

(51) Int. Cl.
*F25B 13/00* (2006.01)
*F24F 1/0059* (2019.01)
(Continued)

(52) U.S. Cl.
CPC ..... *F25B 13/00* (2013.01); *F24F 1/0059* (2013.01); *F24F 1/32* (2013.01); *F25B 40/00* (2013.01);
(Continued)

(58) Field of Classification Search
CPC ..... F25B 13/00; F25B 40/00; F25B 2300/00; F25B 2300/007; F25B 2300/0233;
(Continued)

(56) References Cited

U.S. PATENT DOCUMENTS

2010/0282434 A1* 11/2010 Yabuuchi ..... F25B 13/00 62/238.7
2011/0302941 A1 12/2011 Takata
(Continued)

FOREIGN PATENT DOCUMENTS

CN 109000306 12/2018
JP 2010-048447 3/2010
(Continued)

OTHER PUBLICATIONS

European Search Report dated May 6, 2021 issued in Application No. 21150931.0.
International Search Report dated Feb. 16, 2021.

*Primary Examiner* — Emmanuel E Duke
(74) *Attorney, Agent, or Firm* — KED & Associates

(57) ABSTRACT

Provided is an air conditioning apparatus. The air conditioning apparatus includes an outdoor unit which includes a compressor and an outdoor heat exchanger and through which a refrigerant is circulated, an indoor unit through which water is circulated, a heat exchanger in which the refrigerant and the water are heat-exchanged with each other, a water tube configured to guide the water circulated through the indoor unit and the heat exchanger, a pump installed in the water tube, and a controller configured to analyze an output signal of the pump so as to calculate a ration of an air layer in the water tube, the controller being configured to control a target supercooling degree or target superheating degree of the heat exchanger according to the calculated ratio of the air layer.

20 Claims, 6 Drawing Sheets

(51) Int. Cl.
*F24F 1/32* (2011.01)
*F25B 40/00* (2006.01)

(52) U.S. Cl.
CPC ..... *F25B 2300/00* (2013.01); *F25B 2313/003* (2013.01); *F25B 2313/029* (2013.01); *F25B 2313/031* (2013.01)

(58) Field of Classification Search
CPC ..... F25B 23/0312; F25B 23/0314; F25B 2313/003; F25B 2313/029; F25B 2313/031; F25B 2500/26; F25B 2500/24; F25B 2600/19; F25B 2600/21; F25B 2700/1933; F25B 41/20; F25B 41/40; F25B 49/005; F25B 49/02; F25B 2400/04; F25B 2600/2515; F25B 9/002; F25B 25/005; F24F 1/0059; F24F 1/32; F24F 11/36; F24F 11/64; F24F 11/70; F24F 2140/12; F24F 2140/20; F24F 5/0003; F24F 5/001; F24F 11/49; F24F 11/67; F24F 11/84
See application file for complete search history.

(56) References Cited

U.S. PATENT DOCUMENTS

| | | | | |
|---|---|---|---|---|
| 2012/0006050 | A1 | 1/2012 | Takayama et al. | |
| 2015/0047379 | A1 * | 2/2015 | Honda | F25B 49/02 62/177 |
| 2018/0222287 | A1 | 8/2018 | Mieda et al. | |

FOREIGN PATENT DOCUMENTS

| | | | | |
|---|---|---|---|---|
| JP | 5474050 | | 4/2014 | |
| KR | 10-1250551 | | 4/2013 | |
| KR | 10-2016-0097566 | | 8/2016 | |
| KR | 10-1900901 | | 9/2018 | |
| WO | WO-2009122476 | A1 * | 10/2009 | F24D 11/0235 |

* cited by examiner

AIR CONDITIONING APPARATUS

CROSS-REFERENCE TO RELATED APPLICATIONS

The present application claims priority under 35 U.S.C. 119 and 35 U.S.C. 365 to Korean Patent Application No. 10-2020-0007676 (filed on Jan. 21, 2020), which is hereby incorporated by reference in its entirety.

BACKGROUND

The present disclosure relates to an air conditioning apparatus.

Air conditioning apparatuses are apparatuses that maintain air in a predetermined space to the most proper state according to use and purpose thereof. In general, such an air conditioning apparatus includes a compressor, a condenser, an expansion device, and evaporator. Thus, the air conditioning apparatus has a refrigerant cycle in which compression, condensation, expansion, and evaporation processes of a refrigerant are performed to cool or heat a predetermined space.

The predetermined space may be variously provided according to a place at which the air conditioning apparatus is used. For example, the predetermined space may be a home or office space.

When the air conditioning apparatus performs a cooling operation, an outdoor heat exchanger provided in an outdoor unit may serve as a condenser, and an indoor heat exchanger provided in an indoor unit may serve as an evaporator. On the other hand, when the air conditioning apparatus performs a heating operation, the indoor heat exchanger may serve as the condenser, and the outdoor heat exchanger may serve as the evaporator.

In recent years, according to environmental regulations, there is a tendency to limit the type of refrigerant used in the air conditioning apparatus and to reduce an amount of refrigerant to be used.

To reduce an amount of used refrigerant, a technique for performing cooling or heating by performing heat-exchange between a refrigerant and a predetermined fluid has been proposed. For example, the predetermined fluid may include water.

An air conditioning apparatus in which cooling or heating is performed through heat-exchange between a refrigerant and water is disclosed in US Patent No. 2011-0302941 (Published Date: Dec. 15, 2011) that is a prior art document.

The air conditioning apparatus disclosed in the prior art document includes an outdoor unit including a compressor, an indoor unit including an indoor heat exchanger, and a plurality of heat exchangers in which a refrigerant and water are heat-exchanged with each other and each of which operates as an evaporator or a condenser. An operation mode of each of the plurality of heat exchangers may be determined through control of a valve device.

In case of a water tube through which water flows, an air (gas) layer may be formed in the water tube due to a decrease in gas solubility by an increase in water temperature, poor sealing (leakage) of the tub, or propagation of microorganisms. When the air layer is formed in the water tube, a circulating flow rate of water flowing through the water tube is reduced, and thus, cooling and heating performance may be deteriorated.

Also, since a mixture of air and water is suctioned into a suction end of a pump pumping the water, the pump may be adversely affected in durability.

To solve this limitation, the prior art document discloses a technique for determining the presence or absence of the air layer in the water tube by using a temperature difference between inlet and outlet water of the heat exchanger during a normal operation. However, since causes of change in temperature difference between the inlet and outlet water have various variables (e.g., change in indoor/outdoor temperature, removal or failure of a temperature sensor, etc.) in addition to the air layer in the tube, a ratio of the air layer in the water tube is not accurately known.

SUMMARY

Embodiments provide an air conditioning apparatus in which presence or absence (or ratio) of an air layer in a water tube is accurately known.

Embodiments also provide an air conditioning apparatus in which a ratio of an air layer in a water tube is calculated to determine whether a normal operation is continuously possible so as to take appropriate measures.

Embodiments also provide an air conditioning apparatus that is capable of minimizing deterioration of cooling and heating performance by a decrease in flow rate of water due to formation of an air layer in a water tube.

Embodiments also provide an air conditioning apparatus that is capable of determining whether an air layer is formed in a water tube by a simple control algorithm without a separate device.

In one embodiment, an air conditioning apparatus includes an outdoor unit, an indoor unit, a heat exchanger in which a refrigerant and water are heat-exchanged with each other, a water tube configured to guide the water circulated through the indoor unit and the heat exchanger, a pump installed in the water tube, and a controller configured to analyze an output signal of the pump so as to calculate a ration of an air layer in the water tube, the controller being configured to control a target supercooling degree or target superheating degree of the heat exchanger according to the calculated ratio of the air layer.

Since a ratio of an air layer in a water tube is accurately determined to control a target supercooling degree or a target superheating degree of the heat exchanger, deterioration in cooling and heating performance due to a decrease in water flow rate may be minimized.

The output signal of the pump may include one or more of an amount of current applied to the pump or an amount of power consumed by the pump.

The controller may be configured to compare the ratio of the air layer in the water tube with a predetermined reference ratio, and when it is determined that the ratio of the air layer in the water pump is greater than the reference ratio, the controller may be configured to control a water supply valve so that the water supply valve is opened to supply water to the water tube.

The controller may be configured to open the water supply valve in a state in which operations of the compressor and the pump are stopped.

When it is determined that the ration of the air layer in the water tube is less than the reference ratio, the controller may reduce the target supercooling degree or the target superheating degree of the heat exchanger.

The target supercooling degree or the target superheating degree may be previously determined. The target supercooling degree or the target superheating degree may be about 5 degrees.

The controller may be configured to reduce one of the target supercooling degree or target superheating degree of the heat exchanger.

When the indoor unit performs a heating operation, the controller may be configured to reduce the target supercooling degree of the heat exchanger. The controller may be configured to further determine whether a difference between a high pressure detected at a discharge-side of the compressor and a previously set target high pressure exceeds a reference value.

When the difference between the high pressure detected at the discharge-side of the compressor and the previously set target high pressure exceeds the reference value, the controller may be configured to additionally reduce the target supercooling degree.

When the indoor unit performs a cooling operation, the controller may be configured to reduce the target superheating degree of the heat exchanger. The controller may be configured to further determine whether a difference between a low pressure detected at a suction-side of the compressor and a previously set target low pressure exceeds a reference value.

When the difference between the low pressure detected at the suction-side of the compressor and the previously set target low pressure exceeds the reference value, the controller may be configured to additionally reduce the target superheating degree.

Since the target supercooling degree or the target superheating degree of the heat exchanger is maintained to an appropriate level, reliability and performance of the air conditioning apparatus may be improved.

The air conditioning apparatus may further include a flow valve installed in a liquid guide tube extending from a liquid tube of the outdoor unit to the heat exchanger.

The controller may be configured to allow the flow valve to increase in opening degree in a state in which one of the target supercooling degree and the target superheating degree of the heat exchanger is reduced. An amount of high-pressure rise or low-pressure drop due to the decrease in flow rate of water is reduced to minimize an amount of reduction in operation frequency of the compressor.

The controller may be configured to measure the target supercooling degree or the target superheating degree based on a difference value between a temperature of the refrigerant introduced into the heat exchanger and a temperature of the refrigerant discharged from the heat exchanger.

In another embodiment, an air conditioning apparatus includes an outdoor unit, an indoor unit, a heat exchanger in which a refrigerant and water are heat-exchanged with each other, a water tube configured to guide the water circulated through the indoor unit and the heat exchanger, a pump and a water supply valve, which are installed in the water tube, and a controller configured to measure power consumed in the pump so as to control an opening/closing of the water supply valve based on the measured power consumption.

The controller may be configured to determine whether the power consumed in the pump is reduced by a predetermined rate or more.

When it is determined that the power consumed in the pump is reduced by the predetermined rate or more, the controller may be configured to open the water supply valve so as to supply the water to the water tube. The controller may be configured to open the water supply valve in a state in which operations of the compressor and the pump are stopped.

The controller may be configured to measure the power consumed in the pump in a state in which the pump operates at a maximum output.

The details of one or more embodiments are set forth in the accompanying drawings and the description below. Other features will be apparent from the description and drawings, and from the claims.

DETAILED DESCRIPTION OF THE EMBODIMENTS

Figure 1:
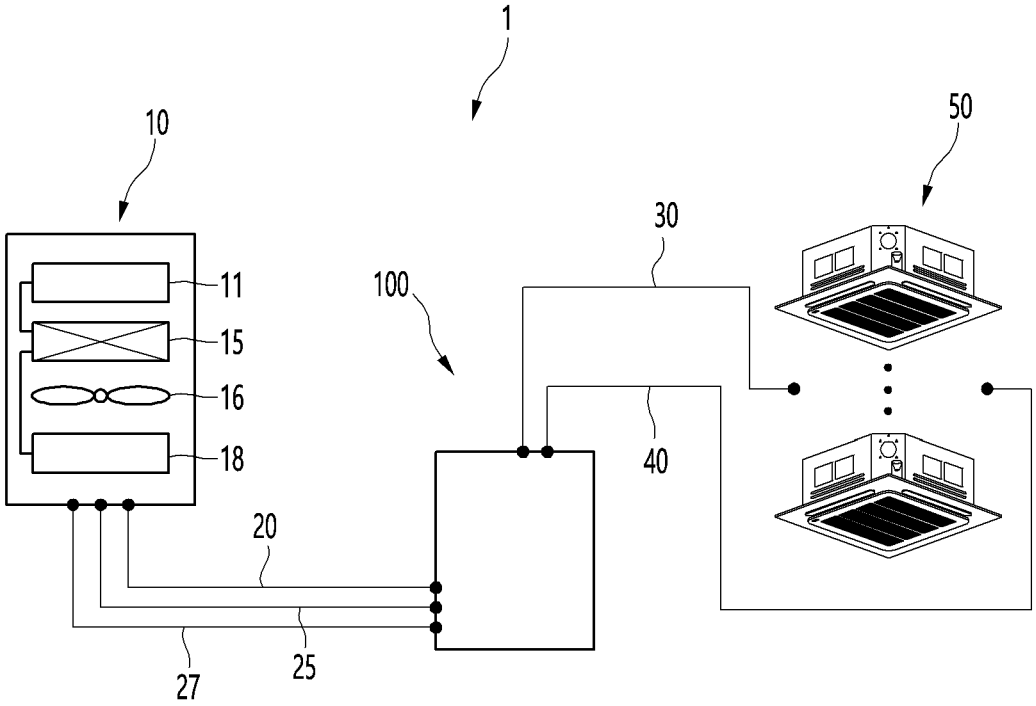
FIG. 1 is a schematic view of an air conditioning apparatus according to a first embodiment.

Hereinafter, some embodiments of the present invention will be described in detail with reference to the accompanying drawings. It is noted that the same or similar components in the drawings are designated by the same reference numerals as far as possible even if they are shown in different drawings. In the following description of the present invention, a detailed description of known functions and configurations incorporated herein will be omitted to avoid making the subject matter of the present invention unclear.

In the description of the elements of the present invention, the terms first, second, A, B, (a), and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a schematic view of an air conditioning apparatus according to a first embodiment.

Figure 2:
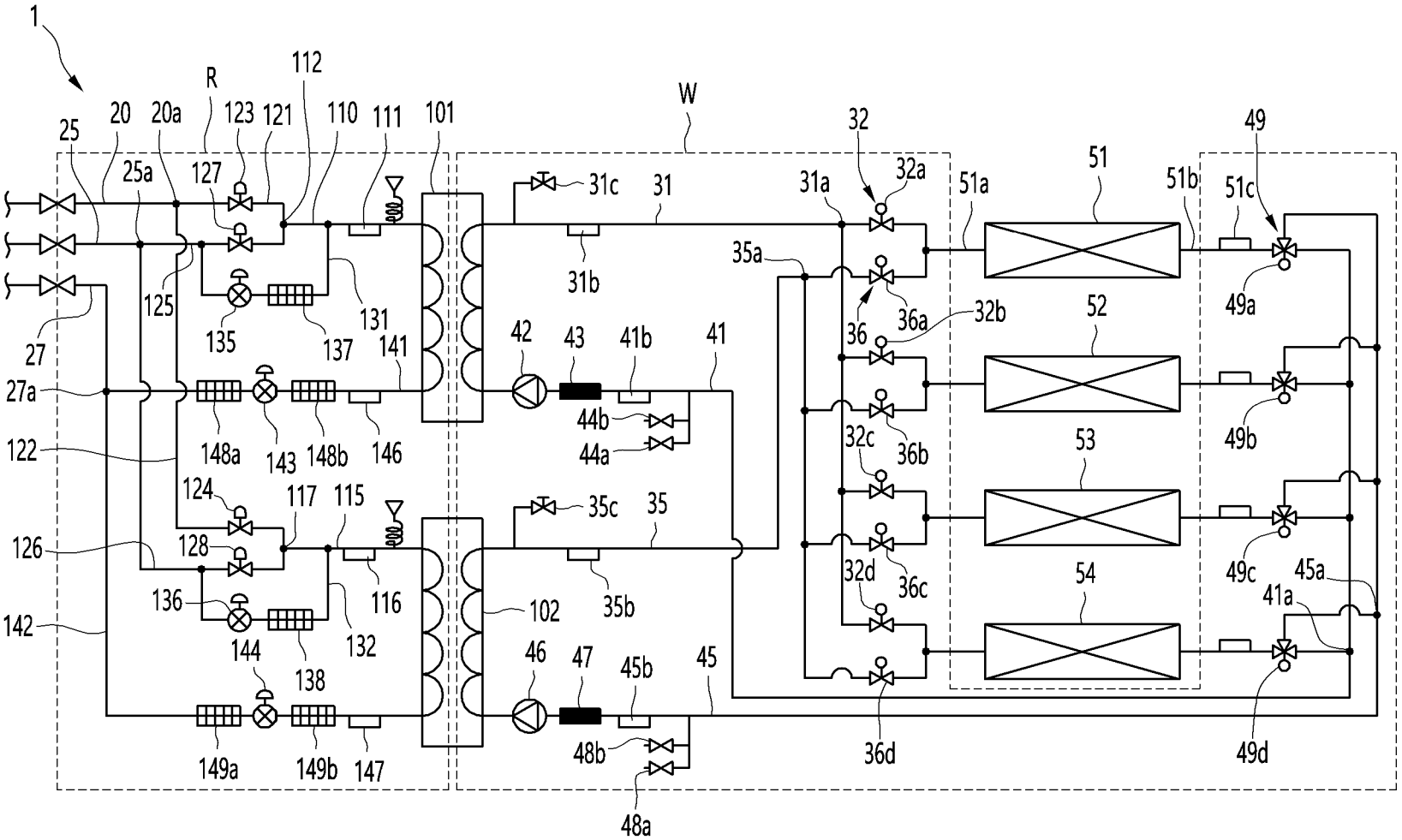
FIG. 2 is a view illustrating a configuration of the air conditioning apparatus according to the first embodiment.

Referring to FIGS. 1 and 2, an air conditioning apparatus 1 according to an embodiment may include an outdoor unit 10, an indoor unit 50, and a heat exchange device 100 in which a refrigerant circulated through the outdoor unit 10 and water circulated through the indoor unit 50 are heat-exchanged with each other.

The heat exchange device 100 may include heat exchangers 101 and 102 in which water and a refrigerant are heat-exchanged with each other and a switching unit R that controls a flow of the refrigerant. The switching unit R may connect the heat exchangers 101 and 102 to the outdoor unit 10 (see FIG. 2).

Here, the outdoor unit 10 may include a simultaneous cooling and heating type outdoor unit.

Also, the switching unit R may switch a flow direction of the refrigerant by an operation of a valve provided therein.

Also, the switching unit R may control a flow rate of the refrigerant by the operation of the valve.

The outdoor unit 10 and the heat exchange device 100 may be fluidly connected to each other by a first fluid. For example, the first fluid may include a refrigerant.

The refrigerant may flow through a refrigerant passage, which is provided in the heat exchange device 100, and the outdoor unit 10.

The outdoor unit 10 may include a compressor 11 and an outdoor heat exchanger 15.

Also, an outdoor fan 16 may be provided at one side of the outdoor heat exchanger 15.

The outdoor fan 16 may blow external air toward the outdoor heat exchanger 15. Due to driving of the outdoor fan 16, heat exchange may be performed between the external air and the refrigerant of the outdoor heat exchanger 15.

Also, the outdoor unit 10 may further include a main expansion valve 18 (EEV).

The air conditioning apparatus 1 may further include three tubes 20, 25, and 27 connecting the outdoor unit 10 to the heat exchange device 100.

The three tubes 20, 25, and 27 may include a high-pressure gas tube 20 through which a high-pressure gas refrigerant flows, a low-pressure gas tube 25 through which a low-pressure gas refrigerant flows, and a liquid tube 27 through which a liquid refrigerant flows.

For example, the high-pressure gas tube 20 may be connected to a discharge-side of the compressor 11. Also, the low-pressure gas tube 25 may be connected to a suction-side of the compressor 11. Also, the liquid tube 27 may be connected to the outdoor heat exchanger 15.

That is, the outdoor unit 10 and the heat exchange device 100 may have a "three-tube connection structure". Also, the refrigerant may be circulated through the outdoor unit 10 and the heat exchange device 100 via the three tubes 20, 25, and 27.

The heat exchange device 100 and indoor unit 50 may be fluidly connected to each other by a second fluid. For example, the second fluid may include water.

The water may flow through a water passage provided in the heat exchange device 100 and the indoor unit 50. That is, the heat exchangers 101 and 102 may be provided so that the refrigerant passage and the water passage are heat-exchanged with each other. For example, each of the heat exchangers 101 and 102 may include a plate type heat exchanger that is capable of performing the heat exchange between the water and the refrigerant.

The indoor unit 50 may include a plurality of indoor units 51, 52, 53, and 54.

Each of the plurality of indoor units 50 may include an indoor heat exchanger (not shown) in which indoor air and water are heat-exchanged with each other and an indoor fan (not shown) that provides air from one side of the indoor heat exchanger.

Also, the air conditioning apparatus 1 may further include water tubes 30 and 40 that guide water flowing to be circulated through the indoor unit 50 and the heat exchange device 100. The water tubes 30 and 40 may form a water circulation cycle W (see FIG. 2).

The water tubes 30 and 40 may include an outlet tube 30 that connects the heat exchange device 100 to one side of the indoor unit 50 and an inlet tube 40 that connects the heat exchange device 100 to the other side of the indoor unit 50.

The inlet tube 40 may be connected to an outlet of the indoor unit 50 to guide the water passing through the indoor unit 50 to the heat exchange device 100.

The outlet tube 30 may be connected to an inlet of the indoor unit 50 to guide the water discharged from the heat exchange device 100 to the indoor unit 50.

That is, the water may be circulated between the heat exchange device 100 and the indoor unit 50 through the water tubes 30 and 40.

According to the above-described constituents, the refrigerant circulated through the outdoor unit 10 and the heat exchange device 100 and the water circulated through the heat exchange device 100 and the indoor unit 50 are heat-exchanged with each other through the heat exchangers 101 and 102 provided in the heat exchange device 100.

Also, water cooled or heated by the heat exchange may be heat-exchanged with the indoor heat exchanger (not shown) provided in the indoor unit 50 to cool or heat an indoor space.

For example, the cooled water that releases heat from the refrigerant may be circulated in the indoor unit 50 operating in a cooling mode. Also, the heated water absorbing heat from the refrigerant may be circulated in the indoor unit 50 operating in a heating mode. Thus, the indoor air suctioned by the indoor fan may be cooled or heated and then discharged again into the indoor space.

FIG. 2 is a view illustrating a configuration of the air conditioning apparatus according to the first embodiment.

Referring to FIG. 2, the water circulation cycle W in which the water is circulated through the heat exchange device 100 and the indoor unit 50 and the heat exchange device 100 will be described in detail.

Referring to FIG. 2, the heat exchange device 100 may include the heat exchangers 101 and 102 in which the first fluid and the second fluid are heat-exchanged with each other.

As described above, the first fluid includes a refrigerant, and the second fluid includes water.

Also, the heat exchangers 101 and 102 may be provided in plurality so as to simultaneously provide the cooling and heating to the indoor unit 50. For example, the heat exchangers 101 and 102 may include a first heat exchanger 101 and a second heat exchanger 102. The first heat exchanger 101 and the second heat exchanger 102 may have the same size and capacity.

Hereinafter, to help understand of the heat exchangers 101 and 102 that are capable of selectively switching the operation modes, description will be made based on a case in which two heat exchangers 101 and 102 are provided.

However, the number of heat exchangers 101 and 102 is not limited thereto.

Thus, the water may be selectively introduced into the first heat exchanger 101 or the second heat exchanger 102 and then be heat-exchanged with the refrigerant according to the indoor unit operating in the cooling or heating mode.

Also, each of the heat exchangers 101 and 102 may include a plate type heat exchanger. For example, the heat exchangers 101 and 102 may be configured so that a refrigerant passage through which the refrigerant flows and a water passage through which the water flows are alternately stacked.

Also, the heat exchange device 100 may further include a switching unit R connecting the heat exchangers 101 and 102 to the outdoor unit 10.

The switching unit R may control a flow direction and a flow rate of the refrigerant circulated through the first heat exchanger 101 and the second heat exchanger 102. The switching unit R will be described in detail later.

The indoor unit 50 may be provided in plurality. For example, the indoor unit 50 may include a first indoor unit 51, a second indoor unit 52, a third indoor unit 53, and a fourth indoor unit 54. Of course, the number of indoor units 50 is not limited thereto.

As described above, the indoor unit 50 and the heat exchange device 100 may be connected to each other through the water tubes 30 and 40 through which water flows. Also, the water tubes 30 and 40 may form a water circulation cycle W in which water is circulated through the indoor unit 50 and the heat exchange device 100. That is, the water may flow through the heat exchangers 101 and 102 and the indoor unit 50 via the water tubes 30 and 40.

In detail, the water tubes 30 and 40 may include inlet tubes 41 and 45 that guide water to flow into the heat exchanger 101 and 102 and an outlet tube 31 that guides water discharged from the heat exchanger 101 and 102.

The inlet tubes 41 and 45 may guide the water passing through the indoor unit 50 to flow to the heat exchangers 101 and 102. Also, the outlet tubes 31 and 35 may guide water passing through the heat exchangers 101 and 102 to flow to the indoor unit 50.

The inlet tubes 41 and 45 may include a first inlet tube 41 that guides water to flow to the first heat exchanger 101 and a second inlet tube 45 that guides water to flow to the second heat exchanger 102.

The outlet tubes 31 and 35 may include a first outlet tube 31 that guides the water passing through the first heat exchanger 101 to flow to the indoor unit 50 and a second outlet tube 45 that guides the water passing through the second heat exchanger 102 to flow to the indoor unit 50.

In detail, the first inlet tube 41 may extend to a water inlet of the first heat exchanger 101. Also, the first outlet tube 31 may extend from a water outlet of the first heat exchanger 101.

Likewise, the second inlet tube 45 may extend to a water inlet of the second heat exchanger 102. Also, the second outlet tube 35 may extend from a water outlet of the second heat exchanger 102.

Also, the outlet tubes 31 and 35 may extend from the water outlets of the heat exchangers 101 and 102 toward the indoor units 51, 52, 53, and 54.

Therefore, the water introduced from the inlet tubes 41 and 45 to the water inlets of the heat exchanger 101 and 102 may be heat-exchanged with the refrigerant and then be introduced into the outlet tubes 31 and 35 through the water outlets of the heat exchangers 101 and 102.

The air conditioning apparatus 1 may further include pumps 42 and 46 installed in the inlet tubes 41 and 45.

The pumps 42 and 46 may provide a pressure so that the water in the inlet tubes 41 and 45 flows to the heat exchangers 101 and 102. That is, the pumps 42 and 46 may be installed in the water tube to set the flow direction of the second fluid.

The pumps 42 and 46 may include a first pump 42 installed in the first inlet tube 41 and a second pump 46 installed in the second inlet tube 45.

The pumps 42 and 46 may force a flow of water. For example, when the first pump 42 is driven, water may be circulated through the indoor unit 50 and the first heat exchanger 101.

That is, the first pump 42 may provide circulation of water through the first inlet tube 41, the first heat exchanger 101, the first outlet tube 31, the indoor inlet tube 51*a*, the indoor units 51, 52, and 53, and the indoor outlet tube 51*b*.

The air conditioning apparatus 1 may further include water supply valves 44*a* and 48*a* and relief valves 44*b* and 48*b*, which are installed in tubes branched from the inlet tubes 41 and 45.

Each of the water supply valves 44*a* and 48*a* may provide water to the inlet tubes 41 and 45 or restrict the flow of the water through an opening/closing operation thereof.

Also, the water supply valves 44*a* and 48*a* may include a first water supply valve 44*a* that is opened or closed to provide water to the first inlet tube 41 and a second water supply valve 48*a* that is opened or closed to provide water to the second inlet tube 45.

Each of the relief valves 44*b* and 48*b* may be provided to reduce a pressure in an emergency through an opening/closing operation thereof when the pressure inside the water tube exceeds a design pressure. The relief valves 44*b* and 48*b* may be referred to as safety valves.

The relief valves 44*b* and 48*b* include a first relief valve 44*b* installed in a tube connected to the first inlet tube 41 and a second relief valve 48*b* installed in a tube connected to the second inlet tube 45.

The air conditioning apparatus 1 may further include water tube strainers 43 and 47 and inlet sensors 41*b* and 45*bm* which are installed in the inlet tubes 41 and 45.

The water tube strainers 43 and 47 may be provided to filter wastes in water flowing through the water tube. For example, each of the water tube strainers 43 and 47 may be provided as a metal mesh.

The water tube strainers 43 and 47 may include a strainer 41 installed in the first inlet tube 41 and a strainer 47 installed in the second inlet tube 45.

The water tube strainers 43 and 47 may be disposed at inlet-sides of the pumps 42 and 47, respectively.

The inlet sensors 41*b* and 45*b* may detect a state of water flowing through the inlet tubes 41 and 45. For example, the inlet sensors 41*b* and 45*b* may be provided as sensors that sense a temperature and pressure.

The inlet sensors 41*b* and 45*b* may include a first inlet sensor 41*b* installed in the first inlet tube 41 and a second inlet sensor 45*b* installed in the second inlet tube 45.

The air conditioning apparatus 1 may further include purge valves 31*c* and 35*c* installed in the outlet tubes 31 and 35.

In detail, the purge valves 31*c* and 35*c* may include a first purge valve 31*c* installed in the first outlet tube 31 and a second purge valve 35*c* installed in the second outlet tube 35.

Each of the purge valves 31*c* and 35*c* may discharge air inside the water tube to the outside through an opening/closing operation thereof.

The air conditioning apparatus 1 may further include temperature sensors 31*b* and 35*b* installed in the outlet tubes 31 and 35.

The temperature sensors 31*b* and 35*b* may detect a state of water heat-exchanged with the refrigerant. For example, each of the temperature sensors 31*b* and 35*b* may include a thermistor temperature sensor.

The temperature sensors 31*b* and 35*b* may include a first temperature sensor 31*b* installed in the first outlet tube 31 and a second temperature sensor 35*b* installed in the second outlet tube 35.

The outlet tubes 31 and 35 may be branched to extend to each of the inlet sides of the plurality of indoor units 51, 52, 53, and 54.

That is, a branch point 31*a* branched into each of the indoor units 51, 52, 53 and 54 may be provided at one end of each of the outlet tubes 31 and 35. The outlet tubes 31 and 35 may be branched from the branch point 31*a* to extend to the indoor inlet tube 51*a* coupled to the inlet of each of the indoor units 51, 52, 53, and 54.

The water tube may further include an indoor inlet tube 51*a* coupled to the inlets of the indoor units 51, 52, 53, and 54.

The indoor inlet tube 51*a* includes a first indoor inlet tube 51*a* coupled to the inlet of the first indoor unit 51, a second indoor inlet tube coupled to the inlet of the second indoor unit 52, a third indoor inlet tube coupled to the inlet of the indoor unit 53, and a fourth indoor inlet tube coupled to the inlet of the fourth indoor unit 54.

The first outlet tube 31 may define a first branch point 31*a* branched into each of the indoor inlet tubes 51*a*. The second outlet tube 35 may define a second branch point 35*a* branched to each of the indoor inlet tubes 51*a*.

That is, each of the first outlet tube 31 branched to extend from the first branch point 31*a* and the second outlet tube 35 branched to extend from the second branch point 35*a* may be combined at each of the indoor inlet tubes 51*a*.

The air conditioning apparatus 1 may further include an opening/closing valves 32 and 36 that controls a flow rate of water flowing into the indoor unit 50.

The opening/closing valves 32 and 36 may restrict the flow rate and the flow of water flowing into the indoor inlet tube 51*a* through an opening/closing operation thereof.

That is, the opening/closing valves 32 and 36 may include a first opening/closing valve 32 installed in the first outlet tube 31 and a second opening/closing valve 36 installed in the second outlet tube 35.

In detail, the first opening/closing valve 32 may be installed in a tube branched from the first branch point 31*a* to extend to each of the indoor inlet tubes 51*a*.

The first opening/closing valve 32 may be installed for each tube branched from the first branch point 31*a*. Thus, the first opening/closing valve 32 may be provided in a number corresponding to the number of indoor units 50.

For example, the first opening/closing valve 32 may include a valve 32*a* installed in a tube connected to the first indoor unit 51, a valve 32*b* installed in a tube connected to the second indoor unit 52, a valve 32*c* installed in a tube connected to the third indoor unit 53, and a valve 32*d* installed in a tube connected to the fourth indoor unit 54.

The second opening/closing valve 36 may be installed in a tube branched from the second branch point 35*a* to extend to each of the indoor inlet tubes 51*a*.

The second opening/closing valve 36 may be installed for each tube branched from the second branch point 35*a*. Thus, the second opening/closing valve 36 may be provided in a number corresponding to the number of indoor units 50.

For example, the second opening/closing valve 36 may include a valve 36*a* installed in a tube connected to the first indoor unit 51, a valve 36*b* installed in a tube connected to the second indoor unit 52, a valve 36*c* installed in a tube connected to the third indoor unit 53, and a valve 36*d* installed in a tube connected to the fourth indoor unit 54.

The water tube may further include an indoor outlet tube 51*b* coupled to the outlet of each of the indoor units 51, 52, 53, and 54.

The indoor outlet tube 51*b* may include a first indoor outlet tube 51*b* coupled to the outlet of the first indoor unit 51, a second indoor outlet tube coupled to the outlet of the second indoor unit 52, a third indoor outlet tube coupled to the outlet of the third indoor unit 53, and a fourth indoor outlet tube coupled to the outlet of the fourth indoor unit 54.

The air conditioning apparatus 1 may further include a detection sensor 51*c* installed in the indoor outlet tube 51*b*.

The detection sensor 51*c* may detect a state of water flowing through the indoor outlet tube 51*b*. For example, the detection sensor 51*c* may be provided as a sensor that detects a temperature and pressure of water.

The detection sensor 51*c* includes a first detection sensor 51*c* installed in the first indoor outlet tube 51*b*, a second detection sensor installed in the second indoor outlet tube, a third detection installed in the third indoor outlet tube, and a fourth detection sensor installed in the fourth indoor outlet tube.

The air conditioning apparatus 1 may further include a flow guide valve 49 to which the indoor outlet tube 51*b* is coupled.

The flow guide valve 49 may control a flow direction of water passing through the indoor unit 50 through an opening/closing operation thereof. That is, the flow guide valve 49 may be controlled to change the flow direction of water.

For example, the flow guide valve 49 may include a three-way valve.

In detail, the flow guide valve 49 may include a first flow guide valve 49*a* installed in the first indoor outlet tube 51*b*, a second flow guide valve 49*b* installed in the second indoor outlet tube, a third flow guide valve 49*c* installed in the third indoor outlet tube, and a fourth flow guide valve 49*d* installed in the fourth indoor outlet tube.

The flow guide valve 49 may be disposed at a combination point at which a tube branched from each of the inlet tubes 41 and 45 to extend to each indoor unit 51, 52, 53, and 54 is connected to each of the indoor outlet tubes 51*b*.

In detail, the indoor outlet tube 51*b* may be coupled to a first port of the flow guide valve 49, the tube branched to extent from the first inlet tube 41 may be coupled to a second port, and the tube branched to extend from the second inlet tube 45 may be coupled to a third port.

Thus, the water passing through the indoor units 51, 52, 53, and 54 may flow to the first heat exchanger 101 or the second heat exchanger 102, which operates in the cooling or heating mode by the opening/closing operation of the flow guide valve 49.

That is, the flow guide valve 49 may be installed in each of the inlet tubes 41 and 45 to control a flow of water discharged from the outlet of each of the indoor units 51, 52, 53, and 54.

The inlet tubes 41 and 45 may define branch points 41*a* and 45*a* that are branched into the indoor units 51, 52, 53 and 54, respectively.

In detail, the first inlet tube 41 may define a first branch point 41*a* branched to each of the indoor units 51, 52, 53, and 54.

The first inlet tube 41 may be branched from the first branch point 41*a* to extend to each of the indoor units 51, 52, 53, and 54. Also, the first inlet tube 41 branched to extend from the first branch point 41*a* may be coupled to the passage guide valve 49.

The second inlet tube 45 may define a second branch point 45*a* branched to each of the indoor units 51, 52, 53, and 54.

The second inlet tube 45 may be branched from the second branch point 45*a* to extend to each of the indoor units 51, 52, 53, and 54. Also, the second inlet tube 45 branched to extend from the second branch point 45*a* may be coupled to the flow guide valve 49.

The branch points 41*a* and 45*a* defined by the inlet tubes 41 and 45 may be referred to as "inlet tube branch points". Also, the branch points 31*a* and 35*a* defined by the outlet tubes 31 and 35 may be referred to as "outlet tube branch points".

The heat exchange device 100 may include a switching unit R for adjusting a flow direction and flow rate of the refrigerant introduced into and discharged from the first heat exchanger 101 and the second heat exchanger 102.

In detail, the switching unit R includes refrigerant tubes 110 and 115 coupled to one sides of the heat exchangers 101 and 102 and liquid guide tubes 141 and 142 coupled to the other sides of the heat exchanger 101 and 102.

Each of the refrigerant tubes 110 and 115 may be coupled to a refrigerant entrance provided at one side of each of the heat exchanger 101 and 102. Also, each of the liquid guide tubes 141 and 142 may be coupled to a refrigerant entrance provided at the other side of each of the heat exchanger 101 and 102.

Thus, the refrigerant tubes 110 and 115 and the liquid guide tubes 141 and 142 may be connected to refrigerant passages provided in the heat exchangers 101 and 102 so as to be heat-exchanged with the water.

Also, the refrigerant tubes 110 and 115 and the liquid guide tubes 141 and 142 may guide the refrigerant to pass through the heat exchangers 101 and 102.

In detail, the refrigerant tubes 110 and 115 may include a first refrigerant tube 110 coupled to one side of the first heat exchanger 101 and a second refrigerant tube 115 coupled to one side of the second heat exchanger 102.

Also, the liquid guide tubes 141 and 142 may include a first liquid guide tube 141 coupled to the other side of the first heat exchanger 101 and a second liquid guide tube 142 coupled to the other side of the second heat exchanger 102.

For example, the refrigerant may be circulated through the first heat exchanger 101 by the first refrigerant tube 110 and the first liquid guide tube 141. Also, the refrigerant may be circulated through the second heat exchanger 102 by the second refrigerant tube 115 and the second liquid guide tube 142.

The liquid guide tubes 141 and 142 may be connected to the liquid tube 27.

In detail, the liquid tube 27 may define a liquid tube branch point 27*a* branched into the first liquid guide tube 141 and the second liquid guide tube 142.

That is, the first liquid guide tube 141 may extend from the liquid tube branch point 27*a* to the first heat exchanger 101, and the second liquid guide tube 142 may extend from the liquid tube branch point 27*a* to the second heat exchanger 102.

The air conditioning apparatus 1 may further include gas refrigerant sensors 111 and 116 respectively installed in the refrigerant tubes 110 and 115 and liquid refrigerant sensors 146 and 147 respectively installed in the liquid guide tubes 141 and 142.

The gas refrigerant sensors 111 and 116 and the liquid refrigerant sensors 146 and 147 may be referred to as "refrigerant sensors".

Also, the refrigerant sensors may detect a state of the refrigerant flowing through the refrigerant tubes 110 and 115 and the liquid guide tubes 141 and 142. For example, the refrigerant sensors may detect a temperature and pressure of the refrigerant.

The gas refrigerant sensors 111 and 116 may include a first gas refrigerant sensor 111 installed in the first refrigerant tube 110 and a second gas refrigerant sensor 116 installed in the second refrigerant tube 115.

The liquid refrigerant sensors 146 and 147 may include a first liquid refrigerant sensor 146 installed in the first liquid guide tube 141 and a second liquid refrigerant sensor 147 installed in the second liquid guide tube 142.

Also, the air conditioning apparatus 1 further includes flow valves 143 and 144 installed in the liquid guide tubes 141 and 142 and strainers 148*a*, 148*b*, 149*a*, and 149*b* installed in both sides of the flow valves 143 and 144.

Each of the flow valves 143 and 144 may adjust a flow rate of the refrigerant by adjusting an opening degree thereof.

Each of the flow valves 143 and 144 may include an electronic expansion valve (EEV). Also, each of the flow valves 143 and 144 may be adjusted in opening degree to adjust a pressure of the refrigerant passing therethrough.

The flow valves 143 and 144 may include a first flow valve 143 installed in the first liquid guide tube 141 and a second flow valve 144 installed in the second liquid guide tube 142.

The strainers 148*a*, 148*b*, 149*a*, and 149*b* may be provided to filter wastes of the refrigerant flowing through the liquid guide tubes 141 and 142. For example, each of the strainers 148*a*, 148*b*, 149*a*, and 149*b* may be provided as a metal mesh.

The strainers 148*a*, 148*b*, 149*a*, and 149*b* may include first strainers 148*a* and 148*b* installed in the first liquid guide tube 141 and second strainers 149*a* and 149*b* installed in the second liquid guide tube 142.

In addition, the first strainers 148*a* and 148*b* may include a strainer 148*a* installed at one side of the first flow valve 143 and a strainer 148*b* installed at the other side of the first flow valve 143. As a result, even if the flow direction of the refrigerant is switched, the wastes may be filtered.

Likewise, the second strainers 149*a* and 149*b* may include a strainer 149*a* installed at one side of the second flow valve 144 and a strainer 149*b* installed at the other side of the second flow valve 144.

The refrigerant tubes 110 and 115 may be connected to the high-pressure gas tube 20 and the low-pressure gas tube 25, respectively. Also, the liquid guide tubes 141 and 142 may be connected to the liquid tube 27.

In detail, the refrigerant tubes 110 and 115 may have refrigerant branch points 112 and 117 at one ends thereof. Also, the refrigerant branch points 112 and 117 may be connected so that the high-pressure gas tube 20 and the low-pressure gas tube 25 are combined with each other.

That is, one ends of the refrigerant tubes 110 and 115 may have refrigerant branch points 112 and 117, and the other ends may be coupled to the refrigerant entrances of the heat exchangers 101 and 102.

The switching unit R may further include high-pressure guide tubes 121 and 122 extending from the high-pressure gas tube 20 to the refrigerant tubes 110 and 115.

The high-pressure guide tubes 121 and 122 may connect the high-pressure gas tube 20 to the refrigerant tubes 110 and 115.

For example, the high-pressure guide tubes 121 and 122 may be integrated with the refrigerant tubes 110 and 115. That is, the refrigerant tubes 110 and 115 may be provided in the high-pressure guide tubes 121 and 122.

The high-pressure guide tubes 121 and 122 may be branched from the high-pressure branch point 20*a* of the high-pressure gas tube 20 to extend to the refrigerant tubes 110 and 115.

In detail, the high-pressure guide tubes 121 and 122 may include a first high-pressure guide tube 121 extending from the high-pressure branch point 20*a* to the first refrigerant tube 110 and a second refrigerant guide tube 122 extending from the second high-pressure branch point 20*a* to the second refrigerant tube 115.

The first high-pressure guide tube 121 may be connected to the first refrigerant branch point 112, and the second high-pressure guide tube 122 may be connected to the second refrigerant branch point 117.

That is, the first high-pressure guide tube 121 may extend from the high-pressure branch point 20*a* to the first refrigerant branch point 112, and the second high-pressure guide tube 122 may extend from the high-pressure branch point 20*a* to the second refrigerant branch point 117.

The air conditioning apparatus 1 may further include high-pressure valves 123 and 124 installed in the high-pressure guide tubes 121 and 122.

Each of the high-pressure valves 123 and 124 may restrict a flow of the refrigerant to each of the high-pressure guide tubes 121 and 122 through an opening/closing operation thereof.

The high-pressure valves 123 and 124 may include a first high-pressure valve 123 installed in the first high-pressure guide tube 121 and a second high-pressure valve 124 installed in the second high-pressure guide tube 122.

The first high-pressure valve 123 may be installed between the high-pressure branch point 20*a* and the first refrigerant branch point 112.

The second high-pressure valve 124 may be installed between the high-pressure branch point 20*a* and the second refrigerant branch point 117.

The first high-pressure valve 123 may control a flow of the refrigerant between the high-pressure gas tube 20 and the first refrigerant tube 110. Also, the second high-pressure valve 125 may control a flow of the refrigerant between the high-pressure gas tube 20 and the second refrigerant tube 115.

The switching unit R may further include low-pressure guide tubes 125 and 126 extending from the low-pressure tube 25 to the refrigerant tubes 110 and 115.

The low-pressure guide tubes 125 and 126 may connect the low pressure tube 25 to the refrigerant tubes 110 and 115.

The low-pressure guide tubes 125 and 126 may be branched from the low-pressure branch point 25*a* of the low-pressure gas tube 25 to extend to the refrigerant tubes 110 and 115.

In detail, the low-pressure guide tube 125 and 126 may include a first low-pressure guide tube 125 extending from the low-pressure branch point 25*a* to the first refrigerant tube 110 and a second low-pressure guide tube 126 extending from the low-pressure branch point 25*a* to the second low-pressure refrigerant tube 115.

The first low-pressure guide tube 125 may be connected to the first refrigerant branch point 112, and the second low-pressure guide tube 126 may be connected to the second refrigerant branch point 117.

That is, the first low-pressure guide tube 125 may extend from the low-pressure branch point 25*a* to the first refrigerant branch point 112, and the second low-pressure guide tube 126 may extend from the low-pressure branch point 25*a* to the second refrigerant branch point 117. Thus, the high-pressure guide tubes 121 and 122 and the low-pressure guide tubes 125 and 126 may be combined with each other at the refrigerant branch points 115 and 117.

The air conditioning apparatus 1 may further include low-pressure valves 127 and 128 installed in the low-pressure guide tubes 125 and 126.

Each of the low-pressure valves 127 and 128 may restrict a flow of the refrigerant to each of the low-pressure guide tubes 125 and 126 through an opening/closing operation thereof.

The low-pressure valves 127 and 128 may include a first low-pressure valve 127 installed in the first low-pressure guide tube 125 and a second low-pressure valve 128 installed in the second low-pressure guide tube 126.

The first low-pressure valve 127 may be installed between a point at which the first refrigerant branch point 112 and a first pressure equalization tube 131 to be described later are connected to each other.

The second low-pressure valve 128 may be installed between a point at which the second refrigerant branch point 117 and a second pressure equalization tube 132 to be described later are connected to each other.

The switching unit R may further include pressure equalization tubes 131 and 132 branched from the first refrigerant tube 110 to extend to the low-pressure guide tubes 125 and 126.

The pressure equalization tubes 131 and 132 may include a first pressure equalization tube 131 branched from one point of the first refrigerant tube 110 to extend to the first low-pressure guide tube 125 and a second pressure equalization tube 132 branched from one point of the second refrigerant tube 115 to extend to the second low-pressure guide tube 126.

Points at which the pressure equalization tubes 131 and 132 and the low-pressure guide tubes 125 and 126 are connected to each other may be disposed between the low-pressure branch point 25*a* and the low-pressure valves 127 and 128, respectively.

That is, the first pressure equalization tube 131 may be branched from the first refrigerant tube 110 to extend to the first low-pressure guide tube 125 disposed between the low-pressure branch point 25*a* and the first low-pressure valve 127.

Similarly, the second pressure equalization tube 132 may be branched from the second refrigerant tube 115 to extend to the second low-pressure guide tube 126 disposed between the low-pressure branch point 25*a* and the second low-pressure valve 128.

The air conditioning apparatus 1 may further include pressure equalization valves 135 and 136 and pressure equalization strainers 137 and 138, which are installed in the pressure equalization tubes 131 and 132.

The pressure equalization valves 135 and 136 may be adjusted in opening degree to bypass the refrigerant in the refrigerant tubes 110 and 115 to the low-pressure guide tubes 125 and 126.

Each of the pressure equalization valves 135 and 136 may include an electronic expansion valve (EEV).

The pressure equalization valves 135 and 136 may include a first pressure equalization valve 135 installed in the first pressure equalization tube 131 and a second pressure equalization valve 136 installed in the second pressure equalization tube 132.

The pressure equalization strainers 137 and 138 may include a first pressure equalization strainer 137 installed in the first pressure equalization tube 131 and a second pressure equalization strainer 138 installed in the second pressure equalization tube 132.

The pressure equalization strainers 137 and 138 may be disposed between the pressure equalization valves 135 and 136 and the refrigerant tubes 110 and 115. Thus, the wastes of the refrigerant flowing from the refrigerant tubes 110 and 115 to the pressure equalization valves 135 and 136 may be filtered, or foreign substances may be prevented from passing therethrough.

The pressure equalization tubes 131 and 132 and the pressure equalization valves 135 and 136 may be referred to as a "pressure equalization circuit".

The pressure equalization circuit may operate to reduce a pressure difference between the high-pressure refrigerant and the low-pressure refrigerant in the refrigerant tubes 110 and 115 when an operation mode of the heat exchangers 101 and 102 is switched.

Here, the operation mode of the heat exchangers 101 and 102 may include a condenser mode operating as the condenser and an evaporator mode operating as the evaporator.

For example, when the heat exchangers 101 and 102 switch the operation mode from the condenser to the evaporator, the high-pressure valves 123 and 124 may be closed, and the low-pressure valves 127 and 128 may be opened.

The air conditioning apparatus 1 may further include a controller (not shown).

The controller (not shown) may control a plurality of valves provided in the switching unit R and a plurality of valves 32, 49, 31*c*, 35*c*, 44*a*, 44*b*, 48*a*, and 48*b* provided in the refrigerant circulation passage W to switch the operation mode of the heat exchangers 101 and 102 according to the cooling or heating mode that is required by the plurality of indoor units 51, 52, 53, and 54.

For example, the controller may control operations of the high-pressure valves 123 and 124, the low-pressure valves 127 and 128, the pressure equalization valves 135 and 136, and the flow valves 143 and 144 according to the operation mode of the heat exchangers 101 and 102.

The controller may measure the degree of supercooling and the degree of superheating of each of the heat exchangers 101 and 102. Particularly, the controller may measure the degree of supercooling of the heat exchangers 101 and 102 when the indoor unit 50 performs the heating operation.

For example, the degree of supercooling may be obtained by using a temperature sensor installed in each of the heat exchangers 101 and 101 to obtain a difference between a temperature of the refrigerant flowing into the heat exchangers 101 and 102 and a temperature of the discharged refrigerant.

Also, when the indoor unit 50 performs the cooling operation, the controller may measure the degree of superheating of each of the heat exchangers 101 and 102.

For example, the degree of supercooling may be obtained by using a temperature sensor installed in each of the heat exchangers 101 and 101 to obtain a difference between a temperature of the refrigerant flowing into the heat exchangers 101 and 102 and a temperature of the discharged refrigerant.

In this embodiment, the target supercooling degree and the target superheating degree of the heat exchanger may be set in advance. The target supercooling degree and the target superheating degree may be set to, for example, about 5 degrees.

During the cooling operation, the controller may control an operation frequency of the compressor 11 and/or an opening degrees of each of the flow valves 143 and 144 to meet the set target supercooling degree.

During the heating operation, the controller may control an operation frequency of the compressor 11 or an opening degrees of each of the flow valves 143 and 144 to meet the set target superheating degree.

An operation in which all the operation modes of the plurality of heat exchangers 101 and 102 are the same is referred to as an "exclusive operation".

The exclusive operation may be understood as a case in which the plurality of heat exchangers operate only as evaporators or only as condensers. Here, the plurality of heat exchangers 101 and 102 are based on the heat exchanger, which is turned on, rather than the heat exchanger, which is turned off.

Also, the operation of the plurality of heat exchangers 101 and 102 in different operation modes is referred to as a "simultaneous operation".

The simultaneous operation may be understood as a case in which some of the plurality of heat exchangers operate as the condensers, and the remaining heat exchangers operate as the evaporators.

Hereinafter, when the first heat exchanger 101 and the second heat exchanger 102 operate as the evaporators, a flow of the refrigerant will be briefly described. That is, when the heat exchangers 101 and 102 operate exclusively for the evaporator, a flow of the refrigerant will be described.

Here, water cooled while passing through the first heat exchanger 101 and the second heat exchanger 102 may be circulated through the indoor units 51, 52, 53, and 54 that operate (turned on) in the cooling mode.

The condensed refrigerant passing through the outdoor heat exchanger 15 of the outdoor unit 10 may be introduced into the switching unit R through the liquid tube 27.

Also, the condensed refrigerant may be branched from the liquid tube branch point 27*a* to flow to the first liquid guide tube 141 and the second liquid guide tube 142.

The condensed refrigerant introduced into the first liquid guide tube 141 may be expanded while passing through the first flow valve 143. In addition, the expanded refrigerant may be evaporated by absorbing heat of water while passing through the first heat exchanger 101.

Likewise, the condensed refrigerant introduced into the second liquid guide tube 142 may be expanded while passing through the second flow valve 144. Also, the expanded refrigerant may be evaporated by absorbing heat of water while passing through the second heat exchanger 102.

The evaporated refrigerant discharged from the first heat exchanger 101 may be introduced into the first low-pressure guide tube 125 through the first refrigerant tube 101 to flow to the low-pressure gas tube 25. Here, the first low-pressure valve 127 is opened, and the first high-pressure valve 123 is closed.

Likewise, the evaporated refrigerant discharged from the second heat exchanger 102 may be introduced into the second low-pressure guide tube 126 through the second refrigerant tube 115 to flow to the low-pressure gas tube 25. Here, the second low-pressure valve 128 is opened, and the second high-pressure valve 128 is closed.

Hereinafter, when the first heat exchanger 101 and the second heat exchanger 102 operate as the condensers, a flow of the refrigerant will be briefly described. That is, when the heat exchangers 101 and 102 operate exclusively for the condenser, a flow of the refrigerant will be described.

Here, water heated while passing through the first heat exchanger 101 and the second heat exchanger 102 may be circulated through the indoor units 51, 52, 53, and 54 that operate (turned on) in the heating mode.

The compressed refrigerant compressed by the compressor 11 of the outdoor unit 10 may be introduced into the switching unit R through the high-pressure gas tube 20.

Also, the compressed refrigerant may be branched from the high-pressure branch point 20*a* to flow to the first high-pressure guide tube 121 and the second high-pressure guide tube 122.

The compressed refrigerant introduced into the first high-pressure guide tube 121 may be introduced into the first heat exchanger 101 through the first refrigerant tube 110. The refrigerant condensed in the first heat exchanger 101 may flow to the liquid tube branch point 27*a* through the first liquid guide tube 141.

The refrigerant may be condensed by losing heat from water while passing through the first heat exchanger 101. Here, the first low-pressure valve 127 is closed, and the first high-pressure valve 123 is opened.

The compressed refrigerant introduced into the second high-pressure guide tube 122 may be introduced into the second heat exchanger 102 through the second refrigerant tube 115. The refrigerant condensed in the second heat exchanger 102 may flow to the liquid tube branch point 27*a* through the second liquid guide tube 142.

The refrigerant may be condensed by losing heat from water while passing through the second heat exchanger 102. Here, the second low-pressure valve 128 is closed, and the second high-pressure valve 124 is opened.

Each of the refrigerants flowing to the liquid tube branch point 27*a* may be mixed and then be introduced into the outdoor heat exchanger 15 of the outdoor unit 10 through the liquid tube 27. Also, the refrigerant evaporated in the outdoor heat exchanger 15 may be suctioned into the compressor 11.

An initial start may be understood as an operation stage in which at least one of the plurality of indoor units 50 starts to operate, and the heat exchangers 101 and 102 start to operate to provide the cooling or heating to the indoor space.

Hereinafter, a method of cooling an air conditioning apparatus will be described in detail with reference to the drawings.

Figure 3:
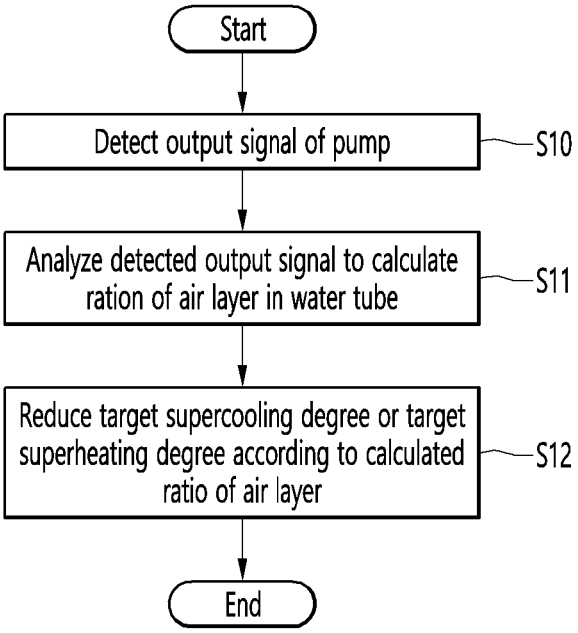
FIG. 3 is a schematic flowchart illustrating a method for controlling an air conditioning apparatus according to the first embodiment.

FIG. 3 is a schematic flowchart illustrating a method for controlling an air conditioning apparatus according to the first embodiment.

Referring to FIG. 3, in operation S10, an air conditioning apparatus 1 detects an output signal of a pump.

Particularly, the air conditioning apparatus 1 may detect an output signal of each of the pumps 42 and 46 installed in inlet tubes 41 and 45.

Here, the output signal of the pump may include an amount of current applied to the pump or an amount of power consumed by the pump (power consumption).

For example, when the driving of the air conditioning apparatus 1 starts, the current is applied to the compressor 11 and the pumps 42 and 46 to drive the compressor 11 and the pumps 42 and 46. When the pumps 42 and 46 are driven, the amount of current applied to the pumps 42 and 46 or power consumption of the pumps 42 and 46 may be detected in real time through a controller or a power meter, which is provided in the air conditioning apparatus 1.

In operation S11, the air conditioning apparatus 1 analyzes the detected output signal to calculate a ratio of an air layer in a water tube.

The air conditioning apparatus 1 may predict the ratio of the air layer in the water tubes 30 and 40, through which water flows, through the output signal (current amount or power consumption) outputted as the pumps 42 and 46 are driven.

Figure 4:
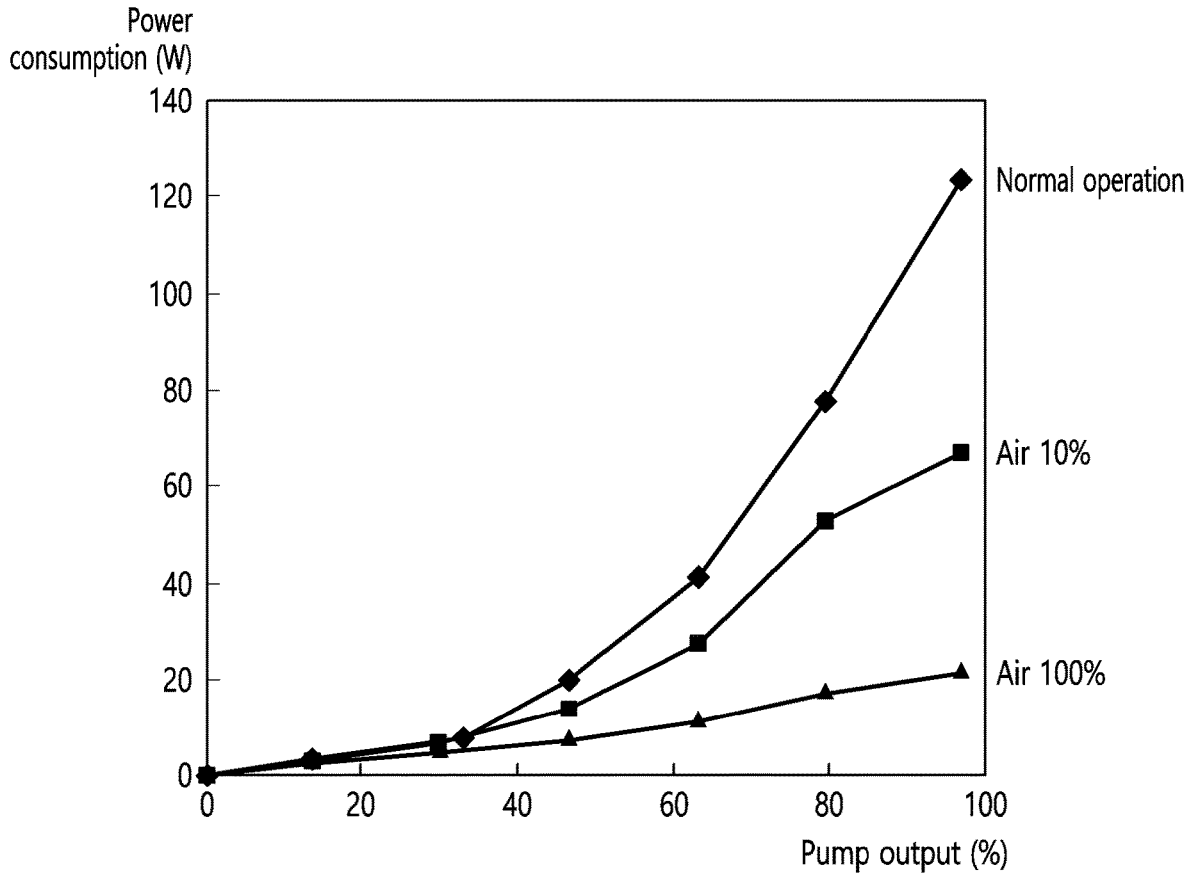
FIG. 4 is a graph illustrating a pump output and power consumption according to a ratio of an air layer in a water tube.

FIG. 4 is a graph illustrating a pump output and power consumption according to a ratio of an air layer in a water tube.

Referring to FIG. 4, a horizontal axis of the graph represents a maximum output ratio (%) of the pump, and a vertical axis of the graph represents power consumption (W) of the pump.

Referring to the graph, during a normal operation of the pumps 42 and 46, when the pump output is about 60%, the power consumption of the pump is about 40 W, and when the pump output is about 95%, the power consumption of the pump is about 120 W.

On the other hand, if the radio of the air layer in the water tubes 30 and 40 is about 10%, when the pump output is about 60%, the power consumption of the pump represents about 23 W, and when the pump output is about 95%, the power consumption of the pump represents about 65 W.

That is, as the ratio of the air layer in the water tubes 30 and 40 increases, the power consumption of the pumps 42 and 46 decreases under the same pump output. This is because when the air layer in the water tube is formed, a load of the pump may be reduced as a circulation flow rate flowing through the water tube decreases.

Therefore, according to this principle, the ratio of the air layer in the water tube may be calculated or predicted through the output signal of the pump.

In operation S12, the air conditioning apparatus 1 reduces the target supercooling degree or the target superheating degree according to the calculated air layer ratio.

Particularly, the air conditioning apparatus 1 determines whether the calculated air layer ratio corresponds to a normal level. Also, if it is determined that the ratio corresponds to the normal level, the target supercooling degree or the target superheating degree may be reduced according to the operation mode.

According to one embodiment, if the air conditioning apparatus 1 determines that the calculated air layer ratio corresponds to the normal level (e.g., less than about 10%), when the current operation mode is the heating operation, the target supercooling degree may be reduced, and when the current operation mode is the cooling operation, the target superheating degree may be reduced.

For example, when the heating operation is performed while the air layer in the water tube is formed, the circulation flow rate in the water tube may decrease, and at this time, the compressor may reduce the operation frequency of the compressor (the output of the compressor) to meet the target high/low pressure (target supercooling of the heat exchanger). When the operation frequency of the compressor is reduced, as a result, the amount of refrigerant circulation in the system may decrease, and cooling and heating performance may be deteriorated.

Therefore, in this embodiment, when the air layer in the water tube is formed, the target supercooling degree or the target superheating degree of the heat exchanger may be reduced to reduce the amount of high-pressure rise or low-pressure drop due to the decrease in water flow rate and thus to alleviate the reduction of the operation frequency of the compressor, thereby minimizing the deterioration of the cooling and heating performance.

Figure 5:
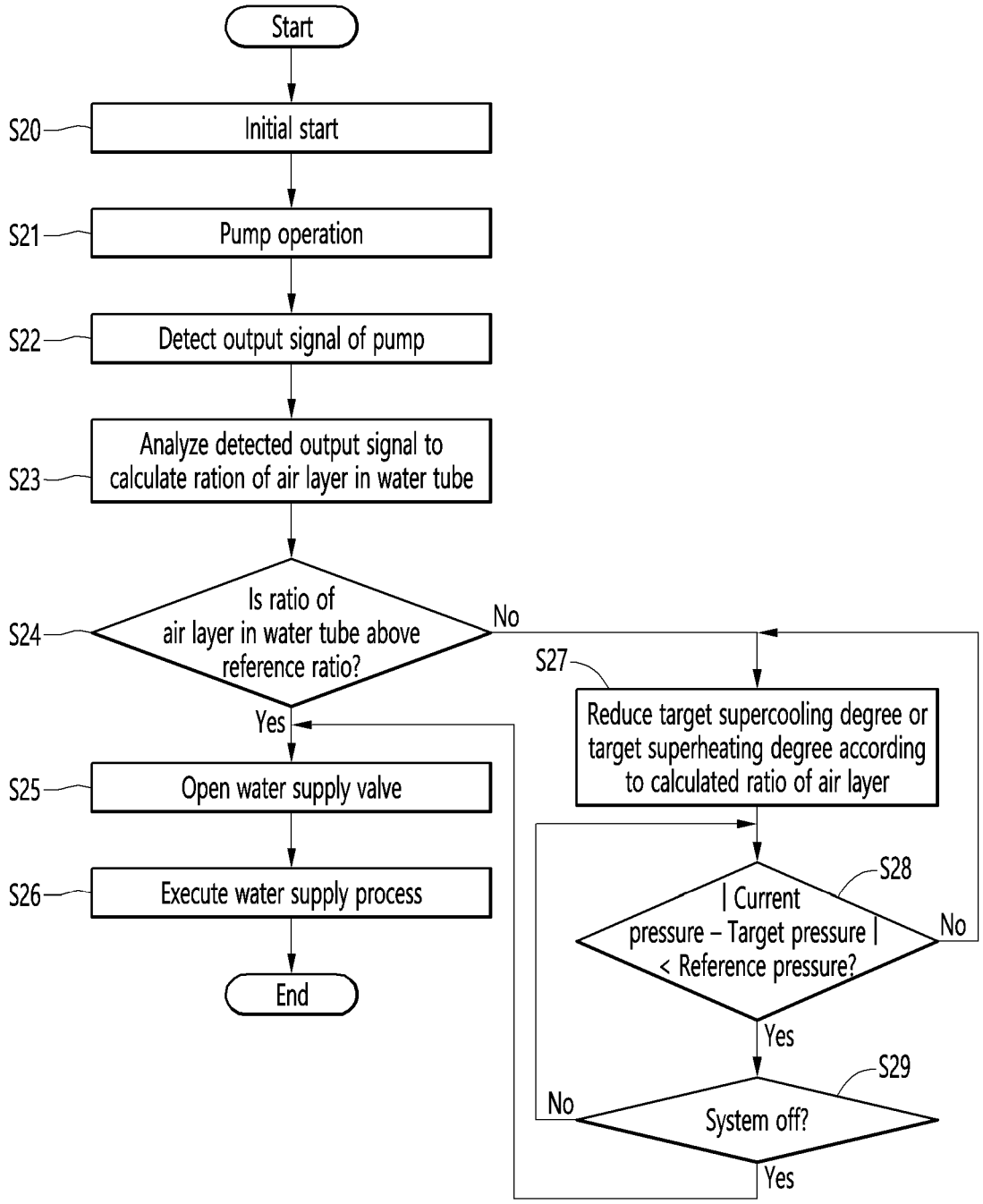
FIG. 5 is a detailed flowchart illustrating the method for controlling the air conditioning apparatus according to the first embodiment.

FIG. 5 is a detailed flowchart illustrating the method for controlling the air conditioning apparatus according to the first embodiment.

Referring to FIG. 5, in operation S20, the air conditioning apparatus 1 performs the initial start, and in operation S21, the pump starts to operate.

Particularly, when the operation of the indoor unit 50 starts, the air conditioning apparatus 1 may perform the initial start in which the heat exchangers 101 and 102 first operate to provide the cooling or heating to the indoor space.

That is, during the initial start, at least one of the indoor units 51, 52, 53, and 54 of the plurality of indoor units 50 may start to be driven.

For example, an occupant may input the heating mode by driving at least one of a plurality of indoor units 50.

Here, the occupant's input may be performed by various input units. For example, each of the input units may include an input portion provided in the air conditioning apparatus 1 or various communication devices such as a remote control or a mobile phone.

As the initial start is performed, the compressor 11 and the pumps 42 and 46 may be driven. Here, the pumps 42 and 46 may be driven at a maximum output.

In operation S22, the air conditioning apparatus 1 detects the output signal of the pump.

As described above, the air conditioning apparatus 1 may detect the output signals of the pumps 42 and 46. Here, the output signal of the pump may include an amount of current applied to the pump or an amount of power consumed by the pump (power consumption).

For example, when the air conditioning apparatus 1 is driven, the current may be applied to the compressor 11 and the pumps 42 and 46 so that the compressor 11 and the pumps 42 and 46 are driven. Here, when the pumps 42 and 46 are driven, the amount of current applied to the pumps 42 and 46 or power consumption of the pumps 42 and 46 may be detected in real time through a controller or a power meter, which is provided in the air conditioning apparatus 1.

In operation S23, the air conditioning apparatus 1 analyzes the detected output signal to calculate a ratio of the air layer in the water tube.

As described above, the air conditioning apparatus 1 may calculate the ration of the air layer in the water tubes 30 and 40, through which water flows, through the amount of current applied to the pumps 42 and 46 or the power consumption of the pumps 42 and 46.

For example, when the amount of current applied to the pumps 42 and 46 or the power consumption of the pumps 42 and 46 is lowered by a certain ratio or more, it may be considered that the ratio of the air layer in the water tubes 30 and 40 is relatively high. That is, as the amount of current or power consumption applied to the pumps 42 and 46 decreases, the ratio of the air layer in the water tubes 30 and 40 may increase.

In operation S24, the air conditioning apparatus 1 determines whether the ratio of the air layer in the water tube is equal to or greater than a reference ratio.

Particularly, to determine whether the ratio of the air layer in the water tube is the normal level, the air conditioning apparatus 1 determines whether the calculated ratio of the air layer in the water tube is equal to or greater than the reference ratio.

Here, the reference ratio may be, for example, about 10%. However, it is not limited thereto, and the reference ratio may be set arbitrarily.

When the ratio of the air layer in the water tube is within the normal level, it may be considered that the normal operation of the air conditioning apparatus 1 is continuously possible.

On the other hand, when the ratio of the air layer in the water tube is above the normal level, it may be considered that the normal operation of the air conditioning apparatus 1 is impossible. In this case, since water and air are introduced into the pumps 42 and 46 in a mixed state, there is a risk of failure of the pumps 42 and 46.

When the ratio of the air layer in the water tube is greater than or equal to the reference ratio, the air conditioning apparatus 1 opens the water supply valve in operation S25 to execute the water supply process in operation S26.

Particularly, when it is determined that the ratio of the air layer in the water tube increases to an abnormal level, the air conditioning apparatus 1 opens the water supply valves 44*a* and 48*a* installed in the inlet tubes 41 and 45 to supply water to the water tubes 30 and 40.

Here, the air conditioning apparatus 1 may stop the operation of each of the pumps 42 and 46 to prevent the pumps 42 and 46 from being damaged.

When a predetermined amount of water is supplied to the water tubes 30 and 40, the water supply valves 44*a* and 48*a* may be closed, and purge valves 31*c* and 35*c* installed in the outlet tubes 31 and 35 may be opened to discharge the air within the water tube to the outside. Also, when the air within the water tube is discharged to the outside, the pumps 42 and 46 may restart after closing the purge valves 31*c* and 35*c*.

On the other hand, when the ratio of the air layer in the water tube is less than the reference ratio, in operation S27, the air conditioning apparatus 1 reduces the target supercooling degree or the target superheating degree according to the operation mode.

Particularly, when it is determined that the ratio of the air layer in the water tube corresponds to the normal level, the air conditioning apparatus 1 determines a current operation mode.

In the heating mode, the target supercooling degree of the heat exchangers 101 and 102 is reduced, and in the cooling mode, the target superheating degree of the heat exchangers 101 and 102 is reduced.

Here, the target supercooling degree and the target superheating degree of the heat exchangers 101 and 102 may be set in advance. For example, each of the target supercooling degree and the target superheating degree may be set to about 5 degrees.

The degree of supercooling and superheating of the heat exchangers 101 and 102 may be obtained by using a temperature sensor to obtain a difference between the temperature of the refrigerant flowing into the heat exchangers 101 and 102 and the temperature of the discharged refrigerant.

The air conditioning apparatus 1 reduces a set target supercooling degree by a predetermined value during the heating operation. For example, the air conditioning apparatus 1 may reduce a set target supercooling degree by about −1 degree. Also, the air conditioning apparatus 1 increases an opening degree of each of the flow valves 143 and 144 to reduce (alleviate) the high-pressure rise due to the decrease in water flow rate.

Also, the air conditioning apparatus 1 reduces the set target superheat by a predetermined value during the cooling operation. For example, the air conditioning apparatus 1 may reduce the set target superheat degree by about −1 degree. Also, the air conditioning apparatus 1 increases an opening degree of each of the flow valves 143 and 144 to reduce (alleviate) the low-pressure drop due to the decrease in water flow rate.

According to this control method, the high pressure rise or the low pressure drop due to the decrease in water flow rate may be alleviated. Accordingly, it is possible to minimize the decrease in operation frequency of the compressor, thereby minimizing the decrease in system performance (cooling and heating performance).

In operation S28, the air conditioning apparatus 1 determines whether the difference between the current pressure and the target pressure is within a reference pressure range.

Particularly, the air conditioning apparatus 1 compares the current pressure (high pressure or low pressure) with the target pressure (target high pressure or target low pressure)

according to each of the operation modes to determine whether the difference between the two pressures is within the reference pressure.

The air conditioning apparatus 1 may determine whether a difference between a high pressure detected by the high pressure sensor and a preset target high pressure is within the reference pressure range during the heating operation.

For example, the controller determines whether a difference between a high pressure detected by a discharge-side of the compressor 11 and the preset target high pressure is within the reference pressure range.

Also, the air conditioning apparatus 1 may determine whether a difference between a low pressure detected by the low pressure sensor and a preset target low pressure is within a reference pressure range during the heating operation.

For example, the controller determines whether a difference between a low pressure detected by a discharge-side of the compressor 11 and the preset target low pressure is within the reference pressure range.

Here, the reason of determining whether the difference value between the current pressure and the target pressure is within the reference pressure range is for appropriately adjusting the target supercooling degree and the target superheating degree according to each of the operation modes. That is, if the target supercooling degree and the target superheating degree of the heat exchangers 101 and 102 are too reduced, the heat exchangers 101 and 102 may be frozen to burst, or the cooling and heating performance may be deteriorated, which may adversely affect reliability of the system.

Therefore, the difference between the current pressure and the target pressure is maintained within a predetermined range to more stably drive the heat exchanger, thereby improving the system performance.

When the difference between the current pressure and the target pressure exceeds the reference pressure range, the air conditioning apparatus 1 enters operation S27 to additionally reduce the target supercooling degree or the target superheating degree.

If the difference between the current pressure and the target pressure falls within the reference pressure range, in operation S29, the air conditioning apparatus 1 receives an input with respect to whether the system is turned off.

For example, the occupant may input an off command for stopping the operation of at least one of the plurality of indoor units 50 through the input unit.

When the off command of the system is not received, the air conditioning apparatus 1 enters operation S28, and when the system off command is received, the air conditioning apparatus 1 enters operation S25.

That is, when the off command of the system of the air conditioning apparatus 1 is inputted, the operation of each of the compressor 11 and the pumps 42 and 46 is stopped, and the water supply valves 44*a* and 48*a* are opened to supply water to the water tube. Accordingly, the air layer in the water tube is removed, and the flow rate of water flowing through the water tube may increase.

Figure 6:
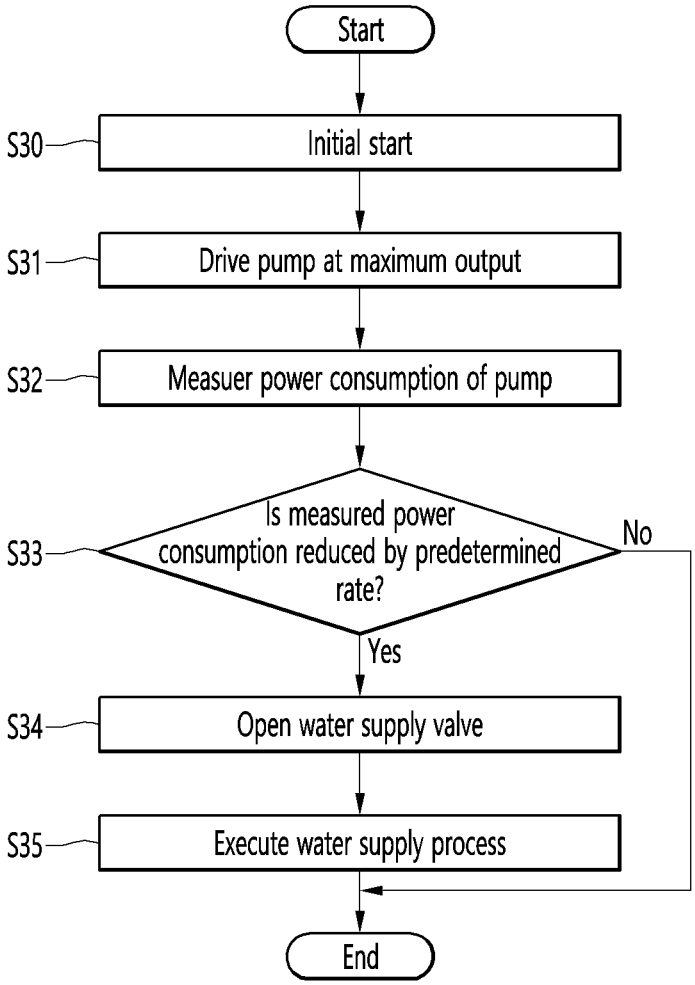
FIG. 6 is a flowchart illustrating a method for controlling an air conditioning apparatus according to a second embodiment.

FIG. 6 is a flowchart illustrating a method for controlling an air conditioning apparatus according to a second embodiment.

Referring to FIG. 6, in operation S30, an air conditioning apparatus 1 performs an initial start, and in operation S31, the pump operates at a maximum output.

Particularly, when an operation of an indoor unit 50 starts, the air conditioning apparatus 1 may perform the initial start in which heat exchangers 101 and 102 first operate to provide cooling or heating to an indoor space.

That is, during the initial start, at least one of indoor units 51, 52, 53, and 54 of a plurality of indoor units 50 may start to be driven.

For example, an occupant may input a heating mode by driving at least one of the plurality of indoor units 50.

Also, pumps 42 and 46 may be driven as the initial start is performed. Here, the pumps 42 and 46 may be driven at a maximum output.

Here, the reason for driving the pumps 42 and 46 at the maximum output is for accurately measuring power consumption of the pumps 42 and 46.

In operation S32, the air conditioning apparatus 1 measures the power consumption of the pump.

For example, when the air conditioning apparatus 1 is driven, current is applied to the pumps 42 and 46 so that the pumps 42 and 46 are driven at a maximum output.

When the pumps 42 and 46 are driven at the maximum output, an amount of power consumed by the pumps 42 and 46 may be measured through a controller or a power meter, which is provided in the air conditioning apparatus 1.

In operation S33, the air conditioning apparatus 1 determines whether the measured power consumption decreases by a predetermined rate or more.

The air conditioning apparatus 1 may determine whether the measured power consumption of the pump is reduced by the predetermined rate or more to check whether an air layer is formed in the water tubes 30 and 40.

As described above, as a ratio of the air layer in the water tubes 30 and 40 is relatively higher, the power consumption of the pumps 42 and 46 may be reduced. Thus, the ratio of the air layer in the water tubes 30 and 40 may be predicted through the measured power consumption.

When the measured power consumption is reduced by the predetermined rate or more, it may be understood that the ratio of the air layer in the water tubes 30 and 40 exceeds a reference ratio. That is, in this case, it may be understood that the ratio of the air layer in the water tube is abnormally large.

On the other hand, when the measured power consumption is not reduced by the predetermined rate or more, it may be understood that the ratio of the air layer in the water tube does not exceed the reference ratio. That is, in this case, it may be understood that the ratio of the air layer in the water tube is abnormal.

If it is determined that the measured power consumption is reduced by the predetermined rate or more, the air conditioning apparatus 1 opens the water supply valve in operation S34 to execute a water supply process in operation S35.

Particularly, when it is determined that the ratio of the air layer in the water tube increases to an abnormal level, the air conditioning apparatus 1 opens the water supply valves 44*a* and 48*a* installed in the inlet tubes 41 and 45 to supply water to the water tubes 30 and 40.

Here, the air conditioning apparatus 1 may stop the operation of each of the pumps 42 and 46 to prevent the pumps 42 and 46 from being damaged.

When a predetermined amount of water is supplied to the water tubes 30 and 40, the water supply valves 44*a* and 48*a* may be closed, and purge valves 31*c* and 35*c* installed in the outlet tubes 31 and 35 may be opened to discharge the air within the water tube to the outside. Also, when the air within the water tube is discharged to the outside, the pumps 42 and 46 may restart after closing the purge valves 31*c* and 35*c*.

According to the air conditioning apparatus according to the embodiment having the above configuration has the following effects.

First, since the ratio of the air layer in the water tube is accurately known using the output signal of the pump, whether the normal operation is continuously possible may be determined to take the appropriate measures.

Second, when it is determined that the ratio of the air layer in the water tube is less than the reference ratio, since it is controlled to reduce the target supercooling degree or the target superheating degree of the heat exchanger, deterioration in cooling and heating performance due to the decrease in flow rate of the water may be minimized.

Third, when it is determined that the ratio of the air layer in the water tube is greater than the reference ratio, the operation of the system may be stopped to stably supply the water to the water tube, thereby significantly improving the reliability of the product.

Fourth, since the degree of opening of the heat exchange-side flow valve is controlled in the state in which the target supercooling degree or the target superheating degree of the heat exchanger is reduced, the amount of high-pressure rise or the low-pressure drop may be reduced due to the reduction in flow rate of the water to minimize the reduction in operation frequency of the compressor.

Fifth, since it is possible to determine whether the air layer is formed in the water tube by the simple control algorithm without the separate device, the cost may be inexpensive, and the compatibility may be easy.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning apparatus comprising:

an outdoor unit which comprises a compressor and an outdoor heat exchanger and through which a refrigerant is circulated;

an indoor unit through which water is circulated;

a heat exchanger in which the refrigerant and the water are heat-exchanged with each other;

a water tube configured to guide the water circulated through the indoor unit and the heat exchanger;

a pump installed in the water tube; and a controller configured to analyze an output signal of the pump so as to calculate a ration of an air layer in the water tube, the controller being configured to control a target supercooling degree or target superheating degree of the heat exchanger according to the calculated ratio of the air layer.

2. The air conditioning apparatus according to claim 1, wherein the output signal of the pump comprises one or more of an amount of current applied to the pump or an amount of power consumed by the pump.

3. The air conditioning apparatus according to claim 1, wherein the controller is configured to compare the ratio of the air layer in the water tube with a predetermined reference ratio, and when it is determined that the ratio of the air layer in the water pump is greater than the reference ratio, the controller is configured to control a water supply valve so that the water supply valve is opened to supply water to the water tube.

4. The air conditioning apparatus according to claim 3, wherein the controller is configured to open the water supply valve in a state in which operations of the compressor and the pump are stopped.

5. The air conditioning apparatus according to claim 1, wherein the controller is configured to compare the ratio of the air layer in the water tube with a predetermined reference ratio, and when it is determined that the ratio of the air layer in the water pump is less than the reference ratio, the target supercooling degree or target superheating degree of the heat exchanger are reduced.

6. The air conditioning apparatus according to claim 5, wherein the controller is configured to reduce one of the target supercooling degree or target superheating degree of the heat exchanger.

7. The air conditioning apparatus according to claim 6, wherein, when the indoor unit performs a heating operation, the controller is configured to reduce the target supercooling degree of the heat exchanger.

8. The air conditioning apparatus according to claim 7, wherein the controller is configured to further determine whether a difference between a high pressure detected at a discharge-side of the compressor and a previously set target high pressure exceeds a reference value.

9. The air conditioning apparatus according to claim 8, wherein, when the difference between the high pressure detected at the discharge-side of the compressor and the previously set target high pressure exceeds the reference value, the controller is configured to additionally reduce the target supercooling degree.

10. The air conditioning apparatus according to claim 6, wherein, when the indoor unit performs a cooling operation, the controller is configured to reduce the target superheating degree of the heat exchanger.

11. The air conditioning apparatus according to claim 10, wherein the controller is configured to further determine whether a difference between a low pressure detected at a suction-side of the compressor and a previously set target low pressure exceeds a reference value.

12. The air conditioning apparatus according to claim 11, wherein, when the difference between the low pressure detected at the suction-side of the compressor and the previously set target low pressure exceeds the reference value, the controller is configured to additionally reduce the target superheating degree.

13. The air conditioning apparatus according to claim 6, further comprising a flow valve installed in a liquid guide tube extending from a liquid tube of the outdoor unit to the heat exchanger.

14. The air conditioning apparatus according to claim 13, wherein the controller is configured to allow the flow valve to increase in opening degree in a state in which one of the target supercooling degree and the target superheating degree of the heat exchanger is reduced.

15. The air conditioning apparatus according to claim 1, wherein the controller is configured to measure the target supercooling degree or the target superheating degree based on a difference value between a temperature of the refrigerant introduced into the heat exchanger and a temperature of the refrigerant discharged from the heat exchanger.

16. An air conditioning apparatus comprising:

an outdoor unit which comprises a compressor and an outdoor heat exchanger and through which a refrigerant is circulated;

an indoor unit through which water is circulated;

a heat exchanger in which the refrigerant and the water are heat-exchanged with each other;

a water tube configured to guide the water circulated through the indoor unit and the heat exchanger;

a pump and a water supply valve, which are installed in the water tube; and a controller configured to measure power consumed in the pump so as to control an opening/closing of the water supply valve based on the measured power consumption.

17. The air conditioning apparatus according to claim 16, wherein the controller is configured to determine whether the power consumed in the pump is reduced by a predetermined rate or more.

18. The air conditioning apparatus according to claim 17, wherein, when it is determined that the power consumed in the pump is reduced by the predetermined rate or more, the controller is configured to open the water supply valve so as to supply the water to the water tube.

19. The air conditioning apparatus according to claim 18, wherein the controller is configured to open the water supply valve in a state in which operations of the compressor and the pump are stopped.

20. The air conditioning apparatus according to claim 18, wherein the controller is configured to measure the power consumed in the pump in a state in which the pump operates at a maximum output.

* * * * *